United States Patent [19]

Scarpino

[11] Patent Number: 5,007,616

[45] Date of Patent: Apr. 16, 1991

[54] CARPET STRETCHING TOOL

[76] Inventor: Kelvin M. Scarpino, 508 Douglas Dr., Denver, Colo. 80221

[21] Appl. No.: 491,165

[22] Filed: Mar. 9, 1990

[51] Int. Cl.[5] ..... B25B 25/00

[52] U.S. Cl. ..... 254/212

[58] Field of Search ..... 254/201, 204, 205, 206, 254/207, 209, 210, 211, 212; 294/8.6

[56] References Cited

U.S. PATENT DOCUMENTS

| | | | |
|---|---|---|---|
| 507,049 | 10/1893 | Tatem et al. | 254/206 |
| 716,904 | 12/1902 | Lawson | 254/209 |
| 4,003,549 | 1/1977 | Sergerie | 254/212 |

*Primary Examiner*—John M. Jillions
*Assistant Examiner*—Charles T. Riggs. Jr.
*Attorney, Agent, or Firm*—Fields, Lewis, Pittenger & Rost

[57] ABSTRACT

In an improved carpet stretching tool characterized by an anchor assembly at the rear of the tubular member which includes a support body telescopingly received in the rear end of the tubular member and releasably fastened thereto, with an inclined socket arranged at an increased angle to accommodate thicker carpets. An elongated anchor member has a straight shank portion inserted into the socket and releasably fastened to the support body, an inclined portion turned down at a selected angle to the shank portion with a beveled section terminating in a point for piercing the carpet. The inclined portion is substantially closer to the vertical than the horizontal which together with the blunt beveled edges ensure a reliable anchor to the floor surface underlying the carpet.

8 Claims, 2 Drawing Sheets

CARPET STRETCHING TOOL

TECHNICAL FIELD

This invention relates to carpet stretching tools and more particularly to a novel and improved carpet stretching tool having an improved anchor assembly.

BACKGROUND ART

For some time there have been available carpet stretching tools having a head with the pointed needles projecting downwardly that extend into the carpet, a rod secured to the head, a tubular arm telescoping over the rod, and a lever-link assembly connected to the head and the tubular arm to displace the head away from the tubular member and with a needle bar secured to the rear end of the tubular member to pierce the carpet and engage the carpet to hold the rear end of the tubular member in place. A tool of this type is disclosed in U.S. Pat. No. 4,003,549.

Further changes have been made in the prior art to ensure a firm holding of the tubular member but in general the anchoring portion of the prior art has not been satisfactory particularly for deep piled carpet. Consequently, the prior art carpet stretching devices have not been entirely reliable and there is a need for an improved carpet stretching tool.

DISCLOSURE OF THE INVENTION

An improved anchor assembly for a carpet stretching tool is characterized by a solid, generally tubular support body that slides into the rear end of the tubular member and is releasably fastened by a fastener such as a pin. An anchor member inserts into an inclined socket extending lengthwise of the body and opening at the front end and is releasably fastened therein. The anchor member has a straight shank portion and an inclined portion arranged at a selected angle to the shank portion. The inclined portion has a substantially uniform cross-section and the free end of the inclined portion terminates in a bevel and point. The angle of the inclined socket is substantially greater than the prior art by a magnitude of about two to one to increase the vertical distance between the point and the bottom of the tubular member to accommodate thicker carpets. The inclined section which extends downwardly and forwardly is at a substantially smaller angle to the vertical by a magnitude of about one half which together with a beveled edge provides a better anchor to the underlying floor surface.

BRIEF DESCRIPTION OF THE DRAWINGS

Details of this invention are described in connection with the accompanying drawings in which like parts bear similar reference numerals and in which.

DETAILED DESCRIPTION

Figure 1:
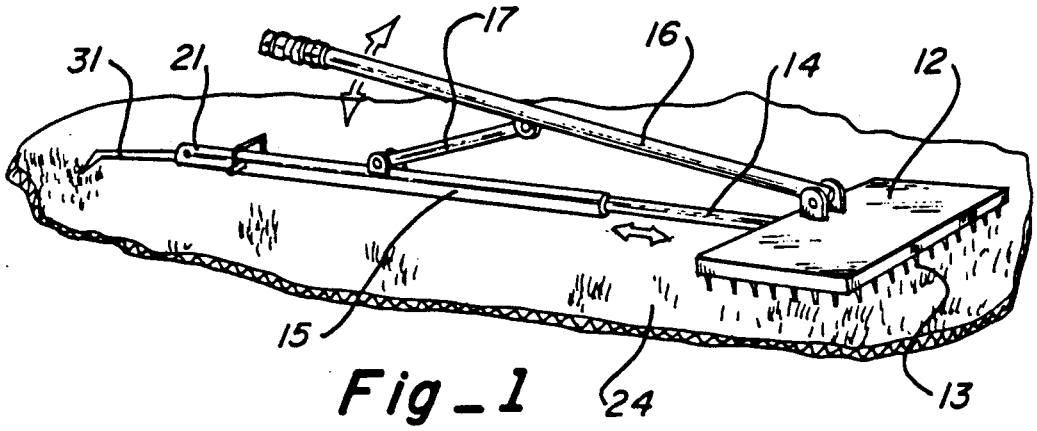
FIG. 1 is a perspective view of a carpet stretching tool on a carpet and provided with an anchor assembly embodying features of the present invention.

Referring now to FIG. 1 there is shown a carpet stretcher tool which includes a head 12 provided with needles 13 which project downwardly from the bottom face of the head, a rod 14 rigidly secured to the rear end of the head and projecting rearwardly therefrom, a tubular member 15 telescopes over the rod for endwise, guided sliding movement thereon, an actuating lever 16 is pivotally connected at one end to the top of the head 12, a link 17 is pivotally connected at one end to an intermediate part of the lever 16 and at the other end to the tubular member 15 so that when the teeth 13 penetrate the carpet 24 and the lever 16 is moved from a raised to a down position force is applied for moving the head 15 forwardly to stretch the carpet in a direction away from the front end of the tubular member. The above described assembly is a general description of the power applying portion of a carpet stretching tool that has been in common use for some time and is similar to that shown in the above listed patent. A needle shown in the above listed patent has a shank that inserts directly into the open rear end of the tubular member and is suitably fastened therein.

Figure 2:
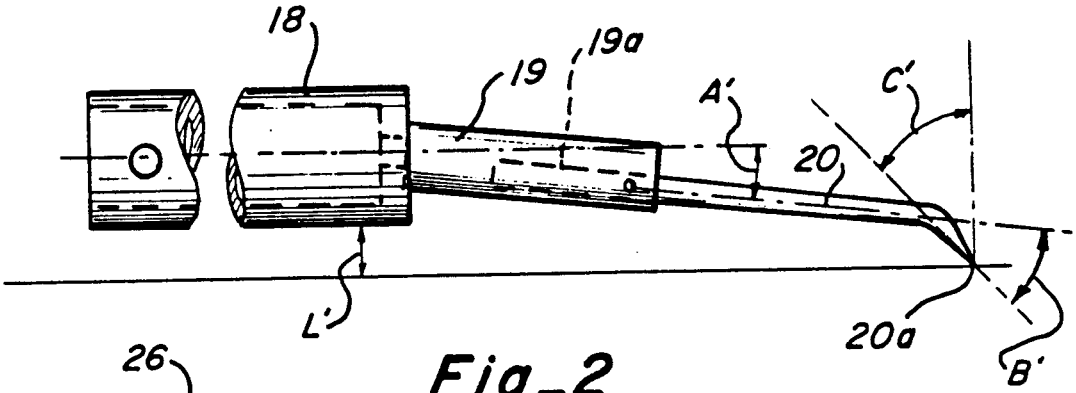
Fig 2 PRIOR ART
FIG. 2 is a side elevation view of a prior art carpet tool.
Figure 3:
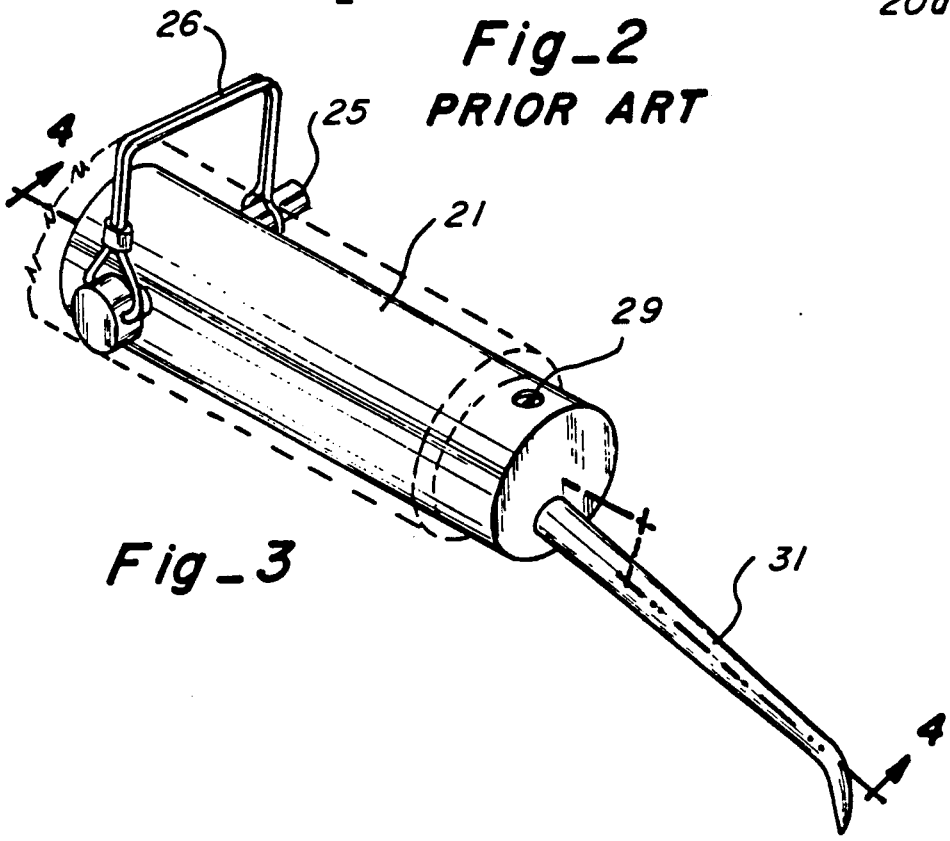
FIG. 3 is a perspective view of the anchor assembly embodying features of the present invention with the rear end of the tubular member shown in dashed lines.
Figure 4:
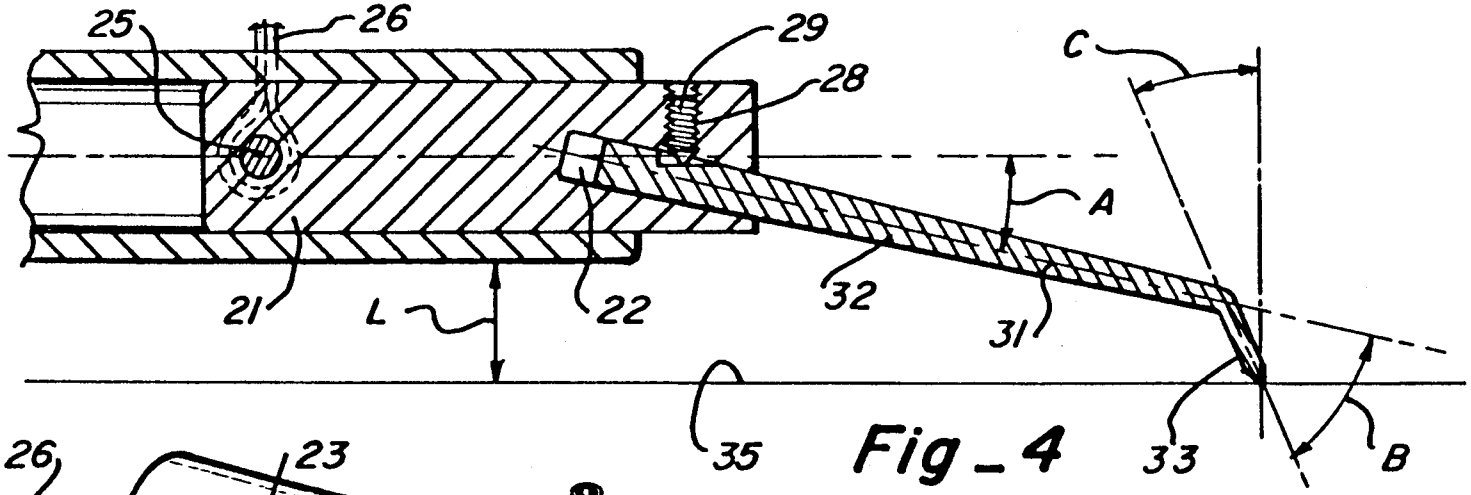
FIG. 4 is a sectional view taken along lines 4—4 of FIG. 3 drawn to half scale of actual size.
Figure 6:
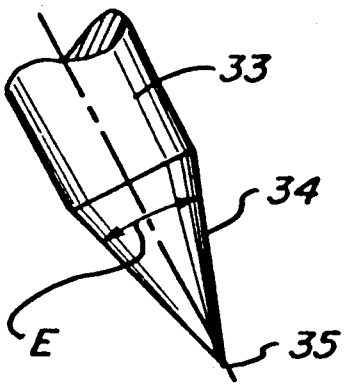
FIG. 6 is an enlarged side elevation view of the end of the anchor member shown in FIGS. 1, 3, 4 and 5.
Figure 5:
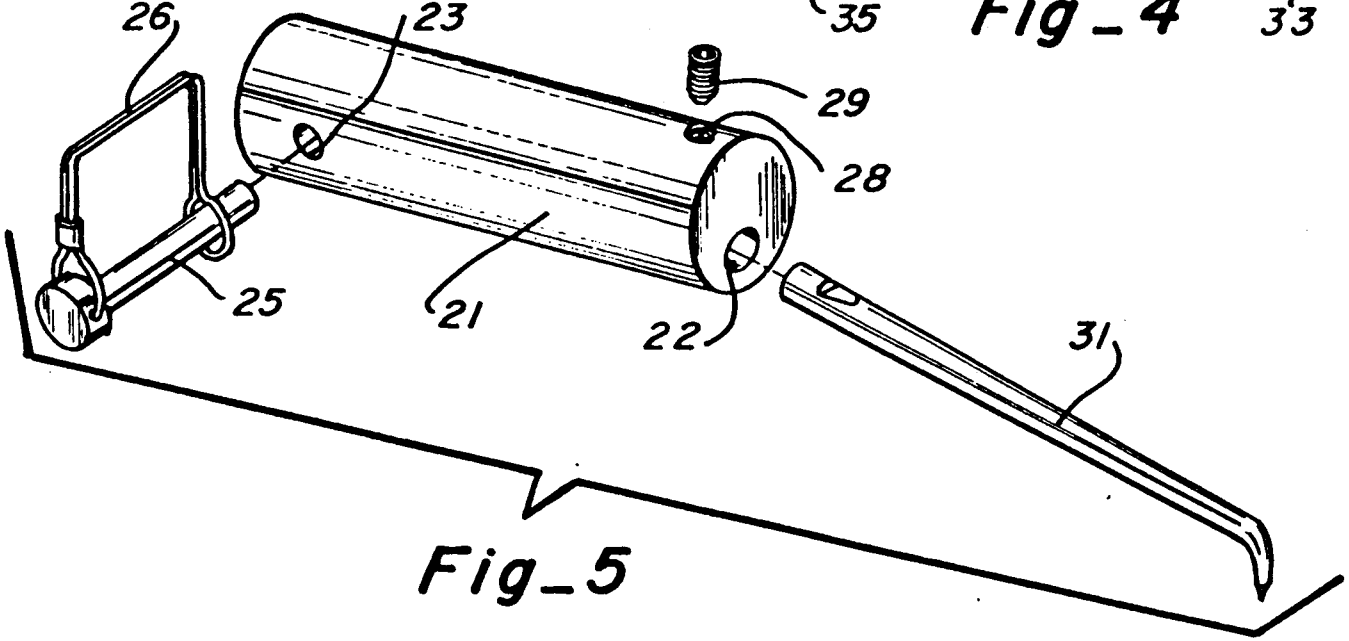
FIG. 5 is a perspective view of the anchor assembly shown in FIG. 1 with the various parts thereof disassembled.

A prior art needle assembly that has been in use shown in FIG. 2 includes a hollow tubular body 18 that inserts into the rear end of the tubular member and is suitably fastened thereto, a square solid rod 19 with a socket 19*a* that receives the rear end of a needle 20 having a penetrating point 20*a* at the free end.

The anchor assembly of the present invention is shown as being removably mounted at the rear of the tubular member 15 and as shown comprises a solid, generally cylindrical support body 21 in which there is formed an inclined socket 22 at the front end that opens at the forward end of the body and extends downwardly and forwardly at a selected angle to the longitudinal axis of the body 21 designated A. This angle A is a significant departure from the horizontal as compared to the prior art shown in FIG. 2 on the order of magnitude of two to one. Specifically, angle A in the embodiment shown is in the range of eight to sixteen degrees and preferably is about 12 degrees which angle A′ in the prior art is about 6 degrees. The beneficial result is an increase of the vertical distance between the bottom of the tubular member 15 and the point 35 designated L as compared with L′ in FIG. 2 to accommodate relatively thick carpets. The body 21 has a vertical internally threaded aperture 28 having an inner end opening into socket 22. A set screw 29 threads into hole 28 and bears against anchor member 31 to releasably lock the anchor member 31 in body 21.

A transverse aperture 23 extends across the body at the rear end. The support body telescopically inserts into the rear end of the tubular member 15 and a pin 25 extends transversely through apertures in the tubular member 15 and transverse aperture 23 to fasten or lock the support body in place in the tubular member. The pin is shown as having a lock 26 to prevent accidental removal.

An elongated anchor member 31 is removably secured in the support body 15. Member 31 includes a straight support shank portion 32 and inclined portion 33 that is turned down at a selected angle designated B to the longitudinal axis of the shank portion. Angle B in the embodiment shown is about 52 degrees. The free end of the inclined portion has a beveled section 34 which terminates in the point 35. The inside angle, designated E, of the V-shaped bevel 34 shown is about 20 degrees.

The complement to the sum of angles A and B is the angle at which the portion 33 inclines rearwardly from the vertical which angle is designated C. This angle in the embodiment shown is in the range of twenty to thirty degrees and preferably is about 26 degrees. By providing a much smaller angle C or a much steeper angle with respect to the horizontal the anchor will not penetrate too far into the wood. This steeper angle that is substantially closer to the vertical than the horizontal and the cross-section of substantially uniform thickness with a bevel providing a blunt penetrating surface contribute to this.

The prior art has an inclined portion that is continuously tapered from end to end with a sharp point and penetrates at an angle C' of about 45 degrees to the vertical. This arrangement has a tendency to penetrate too far and lose the anchoring capability.

It has been found that when the inclined portion is tilted rearwardly at an angle to the vertical of on the order of 45 degrees as is disclosed in the prior art and the continuously tapered cross-section is used, the sharply pointed end penetrates too far, the end portion will lift up and the anchoring capability is lost. However, when this angle is reduced to about 26 degrees so that the section is closer to the vertical and the duller beveled section is used, then the anchor member will provide reliable stop and provide a solid anchor.

By way of illustration and not limitation the shank portion 32 of the embodiment shown is about 6.5 inches and the inclined portion 33 is about one inch.

In use the head 12 is placed at the edge of the carpet and the point 35 inserts into the carpet so that as the downward pressure is applied to lever 16 the point 35 and beveled edge 34 dig into the floor surface. The carpet will tend to slide back up over the entire exposed length of the shank portion 32.

Although the present invention has been described with a certain degree of particularity, it is understood that the present disclosure has been made by way of example and that changes in details of structure may be made without departing from the spirit thereof.

What is claimed is:

1. In a carpet stretching tool including a head having a plurality of needles projecting downwardly from a bottom surface to penetrate a carpet and engage said carpet, a rod member secured to said head and projecting away from said head, a tubular member slidably telescoping over said rod member and disposed in a horizontal position, lever and link means connected to said head and tubular member to move said head away from said tubular member, an improved anchor assembly mounted at the rear end of said tubular member, said anchor assembly comprising:

a support body sized to telescopically insert into an open rear end of said tubular member, said body having an inclined socket turned at a first selected angle to the longitudinal axis of the support body, an elongated anchor member having a straight, elongated shank portion inserted into said socket and an inclined penetrating portion with the longitudinal axis of the inclined penetrating portion turned down at a second selected angle to the longitudinal axis of said shank portion so that said inclined penetrating portion is turned down at a forwardly and downwardly inclined selected third angle to a line perpendicular to said floor surface, a free end of said inclined penetrating portion having a beveled section terminating in a point to provide a relatively blunt penetrating surface for piercing the carpet and engaging the floor surface for anchoring the rear end of said tubular member to said floor surface during the stretching of the carpet away from the anchor member upon the actuation of said lever and link means, said first selected angle being about twelve degrees to provide a vertical distance between the bottom of said tubular member and said point which accommodates relatively thick carpets, said second selected angle being about fifty-two degrees and said third selected angle being about twenty-six degrees to cause said beveled section and point to anchor firmly in said floor surface.

2. In a tool as set forth in claim 1 wherein said bevel has V-shaped surfaces with an inside angle of about 20 degrees.

3. In a tool as set forth in claim 1 wherein said inclined portion has a substantially uniform cross-section from said shank section to said beveled section.

4. In a tool as set forth in claim 1 wherein said support body has a transverse aperture at the rear end adapted to receive a pin for fastening said support body to said tubular member.

5. In a tool as set forth in claim 1 wherein said support body has an internally threaded aperture receiving a set screw that engages said anchor member in said socket to fasten said anchor member in said socket.

6. In a tool as set forth in claim 1 wherein said support body is a solid and of cylindrical shape having an outer surface in close-fitting relation to an inside complementary surface of said tubular member.

7. In a carpet stretching tool including a head having a plurality of needles projecting downwardly from a bottom surface to penetrate a carpet and engage said carpet, a rod member secured to said head and projecting away from said head, a tubular member slidably telescoping over said rod member and disposed in a horizontal position, lever and link means connected to said head and tubular member to move said head away from said tubular member, an improved anchor assembly mounted at the rear end of said tubular member, said anchor assembly comprising:

a generally cylindrical, solid support body sized to telescopically insert into an open rear end of said tubular member, said body having an inclined socket turned at a first selected angle to the longitudinal axis of the support body, an elongated anchor member having a straight, elongated shank portion inserted into said socket and an inclined penetrating portion with the longitudinal axis of the inclined penetrating portion turned down at a second selected angle to the longitudinal axis of said shank portion so that the inclined portion is turned down at a forwardly and downwardly inclined selected third angle to a line perpendicular to said floor surface, a free end of said inclined penetrating portion having a beveled section terminating in a point to provide a relatively blunt penetrating surface for piercing the carpet and engaging the floor surface for anchoring the rear end of said tubular member to said floor surface during the stretching of the carpet away from the anchor member upon the actuation of said lever and link means, said first selected angle being about twelve degrees to provide a vertical distance between the bottom of said tubular member and said point which accommodates relatively thick carpets, said second selected angle being about fifty-two degrees and said third selected angle being about twenty-six degrees to cause said beveled section and point to anchor firmly in said floor surface.

8. In a carpet stretching tool including a head having a plurality of needles projecting downwardly from a bottom surface to penetrate a carpet and engage said carpet, a rod member secured to said head and projecting away from said head, a tubular member slidably telescoping over said rod member and disposed in a horizontal position, lever and link means connected to said head and tubular member to move said head away from said tubular member, an improved anchor assembly mounted at the rear end of said tubular member, said anchor assembly comprising:

a generally cylindrical, solid support body sized to telescopically insert into an open rear end of said tubular member, said body having an inclined socket turned at a first selected angle to the longitudinal axis of the support body, an elongated anchor member having a straight, elongated shank portion inserted into said socket and an inclined penetrating portion with the longitudinal axis of the inclined penetrating portion turned down at a second selected angle to the longitudinal axis of said shank portion so that the inclined portion is turned down at a forwardly and downwardly inclined selected third angle to a line perpendicular to said floor surface, a free end of said inclined penetrating porting having a beveled section terminating in a point to provide a relatively blunt penetrating surface for piercing the carpet and engaging the floor surface for anchoring the rear end of said tubular member to said floor surface during the stretching of the carpet away from the anchor member upon the actuation of said lever and link means, said first selected angle being between eight and sixteen degrees to provide a vertical distance between the bottom of said tubular member and said point which accommodates relatively thick carpet, said third selected angle being between twenty and thirty degrees to cause said beveled section and point to anchor firmly in said floor surface.

* * * * *